US005606914A

United States Patent [19]

Borgardt

[11] Patent Number: 5,606,914

[45] Date of Patent: Mar. 4, 1997

[54] PROCESS AND DEVICE FOR PRINTING SHEETING IN ROTARY OFFSET PRESS

[75] Inventor: Detta Borgardt, Bremervörde, Germany

[73] Assignee: Cleanpack GmbH Innovative Verpackungen, Germany

[21] Appl. No.: 592,368

[22] PCT Filed: Jul. 29, 1994

[86] PCT No.: PCT/EP94/02524

§ 371 Date: Jan. 23, 1996

§ 102(e) Date: Jan. 23, 1996

[87] PCT Pub. No.: WO95/03941

PCT Pub. Date: Feb. 9, 1995

[30] Foreign Application Priority Data

Jul. 30, 1993 [DE] Germany ..... 43 25 725.9

[51] Int. Cl.[6] ..... B41F 23/04

[52] U.S. Cl. ..... 101/488; 101/484; 101/491; 101/417; 101/424.1; 101/424.2; 101/487; 101/216; 226/10; 226/45; 34/625

[58] Field of Search ..... 101/483, 484, 101/487, 488, 216, 491, 492, 417, 424.1, 424.2, DIG. 42, DIG. 43, 219, 225; 226/10, 45; 34/62, 68, 611, 618, 625

[56] References Cited

U.S. PATENT DOCUMENTS

| | | | |
|---|---|---|---|
| 2,971,460 | 2/1961 | Shindle | 101/424.2 |
| 3,273,498 | 9/1966 | Martin | 101/488 |
| 3,312,126 | 4/1967 | Hering, Jr. . | |
| 4,145,386 | 3/1979 | Rosenthal . | |
| 4,170,681 | 10/1979 | Edwards et al. | 101/424.2 |
| 4,449,453 | 5/1984 | Staffer et al. | 101/424.1 |
| 4,515,105 | 5/1985 | Danta et al. | 101/424.2 |
| 4,567,673 | 2/1986 | Böhnensieker | 34/68 |
| 4,852,492 | 8/1989 | Pfizenmaier | 101/424.1 |
| 4,882,992 | 11/1989 | Schmoeger | 101/424.1 |
| 5,189,960 | 3/1993 | Valentini et al. | 101/487 |
| 5,375,518 | 12/1994 | Kurz | 101/487 |

FOREIGN PATENT DOCUMENTS

| | | | |
|---|---|---|---|
| 1539390 | 9/1968 | France . | |
| 2020584 | 12/1971 | Germany | 101/424.2 |
| 2460612 | 6/1976 | Germany | 101/424.1 |
| 9314967 U | 1/1994 | Germany . | |
| 0051592 | 4/1980 | Japan | 101/424.1 |
| 0036167 | 2/1985 | Japan | 101/424.1 |
| 1076698 | 7/1967 | United Kingdom | 101/488 |
| 1281448 | 7/1972 | United Kingdom . | |
| 2002690 | 2/1979 | United Kingdom . | |
| 2146949 | 5/1985 | United Kingdom | 101/424.1 |
| WO87/05237 | 9/1987 | WIPO . | |

*Primary Examiner*—Eugene H. Eickholt
*Attorney, Agent, or Firm*—Anthony J. Casella; Gerald E. Hespos

[57] ABSTRACT

A method and an apparatus for the printing of foil webs in web offset printing are proposed in which strongly oxidatively drying inks are used, the printed foil webs are subjected to a heat-air drying, the printed foil webs are furthermore conducted over at least one cooling roll before they are wound up, and the tension of the web upon the winding is reduced as the diameter of the roll increases.

26 Claims, 2 Drawing Sheets

PROCESS AND DEVICE FOR PRINTING SHEETING IN ROTARY OFFSET PRESS

FIELD OF THE INVENTION

The present invention relates to a process and an apparatus for printing webs of foil by web offset printing.

DESCRIPTION OF THE PRIOR ART

In the manufacture of plastic lids for food containers, for instance margarine cups, plastic foils are first of all printed flat and then brought into the desired shape by, for instance, deep-drawing.

At the present time, various processes are employed for the printing of the plastic material. For all processes, suitable plastic material is first of all extruded in the form of foil webs and wound onto rolls.

Large runs are printed in rotogravure with inks having a high content of solvent, a lengthy IR drying time being necessary. The production of the gravure cylinder is, of course, very difficult and expensive and requires long lead times (as a rule, at least six weeks). For these reasons, the rotogravure process cannot be employed for medium-size runs or where changes in design in a short time are desired.

It is furthermore known to print foil webs with UV drying inks in the web offset process. To be sure, strict requirements with respect to compatibility with the environment (see, for instance, Technical Instruction—Air) apply to UV-drying inks. This process is also only conditionally suitable for the manufacture of plastic containers. The foil webs printed in this way can, to be sure, also be shaped, but the UV-drying inks are brittle and cracks therefore occur upon the shaping so that the finished containers are not acceptable, at least from an aesthetic standpoint.

For medium-size runs, a sheet offset printing process is at present employed. The extruded plastic webs are cut into sheets, which are stacked. The sheets are then printed individually with oxidatively drying inks in a sheet-offset printing press by the dry offset printing process. The sheets then pass, one after the other, through an IR drying device. Before the stacking of the sheets, they are powdered with, for instance, a flour. A suitable particle size assures aeration between the sheets and thus easier drying and at the same time prevents the ink which has been applied and dried from detaching itself from the plastic layer and transferring itself onto the back of the sheet lying on top of it. Before the further processing of the sheets for the manufacture of, for instance, foodstuff containers, the sheets are again individualized and welded to each other at their edge so as to form a web, since it is only in web form that the printed material can be introduced economically into a suitable vacuum deep-drawing machine in which the container is shaped.

This process for medium-size runs of first of all cutting the plastic webs into sheets which are then individually printed, and then again bringing said sheets into web form by welding them together is, of course, very expensive. Therefore, for a long time it has been endeavored to print the plastic webs by web-offset printing before the deep-drawing. One problem in this connection is that UV inks which dry easily and rapidly by UV irradiation cannot be used in the offset printing process since - - - as mentioned above - - - the UV inks tear apart or become unsightly due to their brittle character upon the subsequent deep-drawing of the plastic web.

The use of oxidatively drying inks has not led to satisfactory results in web offset printing up to now despite many attempts by those skilled in the art. Since the oxidatively drying inks are not completely dried upon emergence from the IR drying device, the above-mentioned "transfer" onto the back of the following portion of the web occurs upon the winding of the web onto rolls.

With the present sheet offset printing process, on the average (including stop times) about 5000 sheets per hour are printed. The maximum speed of the sheet offset printing process is about 6500 sheets per hour. This would correspond in web offset printing to a speed of about 50 meters per minute (with a length of sheet of about ½ meter). Even attempts at operating the web offset printing with even lower printing speeds in order to achieve sufficient drying before the rolling-up of the web have failed up to now. Furthermore, all previous attempts of those skilled in the art to obtain faster drying of the oxidative drying inks before the rolling-up of the web by a greater application of heat have failed.

Thus, the problem forming the basis of the invention is to provide a process and an apparatus by which foil webs can be economically printed with oxidatively drying inks in web offset printing.

SUMMARY OF THE INVENTION

By the combination of features of the invention, the result is surprisingly obtained that foil webs can be economically printed with oxidatively drying inks by web offset printing. By the use of strongly oxidatively drying inks relatively short drying times result. Another essential feature is the combined heat/air drying by which the oxidative drying of the inks is achieved in optimal manner. By the air-drying portion, new oxygen is continuously fed to the layer of ink to be dried. Before they are wound up, the printed foil webs which have been subjected to the heat-air drying are conducted over at least one cooling roller, as a result of which the layer of ink is "quenched". One possible explanation for the effectiveness of this measure is that, due to the strong cooling, a sort of skin is formed over the ink which is still not yet completely dry, so that the foil web can be wound up without the still incompletely dried ink transferring itself to the rear of the sections of foil web which are wound-up thereafter. By the gradual reduction of the tension in the web with the increase in the diameter of the roll, the pressure on the inner parts of the wound roll is prevented in advantageous manner from increasing too greatly. In this way, the danger is advantageously counteracted that, as a result of the increasingly greater pressure on the core regions of the roll upon the winding-up, the layer of ink which as a general rule has not yet completely dried there would otherwise "transfer" itself to the rear of the foil web above it.

Before the printing, the foil web is preferably subjected to a corona pretreatment, which therefore makes the foil web "friendly" so that it accepts the ink better.

In accordance with a preferred embodiment, the printing is effected in so-called water-less offset printing, or dry offset printing, in which the printing plates are temperature-controlled and therefore, as a rule, cooled. In particular, upon dry offset printing it is advantageous to control the temperature also of the inks themselves in the inking units. The printing plates should be brought to temperatures of less than 27° C. and optimally to 23° C., and the temperature of the inking unit should preferably be 25° to 26° C.

After the application of the ink, a varnish which covers the entire printing is preferably applied. Since particularly in the case of multicolor offset printing with, for instance, three or four colors, each ink as a rule is applied to different regions of the surface, a uniform surface is obtained by the varnish which is to be applied thereover, which leads to a more uniform drying. As varnish, in particular acrylic varnish is suitable.

The heat-air drying hot-air drying advantageously comprises a given percentage of heat drying and a given percentage of air drying, depending on the printing conditions. It has been found that, depending on the printing conditions, and therefore, in particular, on the percentage of black in the print, the temperature, and the type or mixture of ink, in each case a different adjustment of the drying device is advantageous. The percentage is variable, in which connection, however, a given percentage of air drying must always be present in order to feed sufficient oxygen to the oxidatively drying ink during the drying process. The drying air in this connection is preferably cold air within a temperature range of 5° C. to 25° C.

In accordance with a preferred embodiment, the printed foil web which has been subjected to the heat-air drying is conducted, before being wound up, over two cooling rolls, the web being first of all conducted with its unprinted side over a first cooling roll and then with its printed side over another cooling roll. An explanation of the fact that it is possible at all to conduct the printed side of the web over a cooling roll resides probably in the fact that due to the cooling effected by the first cooling roll the foil web as a whole is "quenched" to such an extent that a skin is formed over the layer of ink or varnish. Due probably to this "skin", the conducting of the printed side of the foil web over the further cooling roll does not result in any impairment in the quality of the print. The cooling rolls preferably have a temperature within the range of 5° C. to 15° C. It is furthermore essential that, in particular, the cooling roll over which the printed side of the foil webs is conducted be driven in synchronism with the speed of the web so that there is no difference in speed at any time between roll and web.

In accordance with another preferred embodiment, after the heat-air drying and before the foil web is wound up, it is powdered in known manner with, for instance, a rice powder or a potato powder of a particle size which assures a certain aeration between sections of the foil web which lie above one another and thus assures an easier drying out.

The winding web tension preferably decreases linearly with the increase in the diameter of the roll. To be sure, it is also possible to reduce the tension progressively or degressively.

It is furthermore advantageous to provide the rolling or unrolling unit in each case with a known roll change device so that changes of rolls can be effected without interrupting the printing.

It is of particular advantage furthermore to provide the printing device with replaceable format drawers with different printing-plate sizes for the printing of sections of different length. When printing copy for, for instance, food container lids in very large runs, large amounts of cuttings can result with a constant size of the printing plate and variation of the size of the lid. This can be optimized by, for instance, providing three different sizes of printing plate. With only three different printing-plate sizes, the greatest part of all food-container lids or lid sizes can be printed economically and therefore without excessive cuttings.

In particular in the field of foodstuffs, it is frequently desirable or even demanded for marketing reasons that printing be effected with gold inks. Attractive gold inks exist as a general rule only in the form of UV drying inks. To this extent it may be advantageous to provide in the printing press a special inking unit, for instance, for UV-drying gold inks, in which case a UV-drying device should be associated directly with the inking or printing unit in order to dry the gold ink before entrance into a subsequent inking unit. In connection with the special ink printing device, a gravure unit can, for instance, also be provided. If both oxidative drying and UV-drying inks are printed on a foil web, it is as a general rule unavoidable to provide behind same a varnishing unit such as already described above. Acrylic varnish has the advantage that it dries faster than the oxidatively drying inks.

IR-drying units are particularly suitable as heat-drying units.

BRIEF DESCRIPTION OF THE DRAWINGS

Other advantages, features and possibilities for the use of the present invention will become evident from the following description of an embodiment, read in conjunction with the drawing, in which.

DETAILED DESCRIPTION OF THE PREFERRED EMBODIMENT

Figure 1:
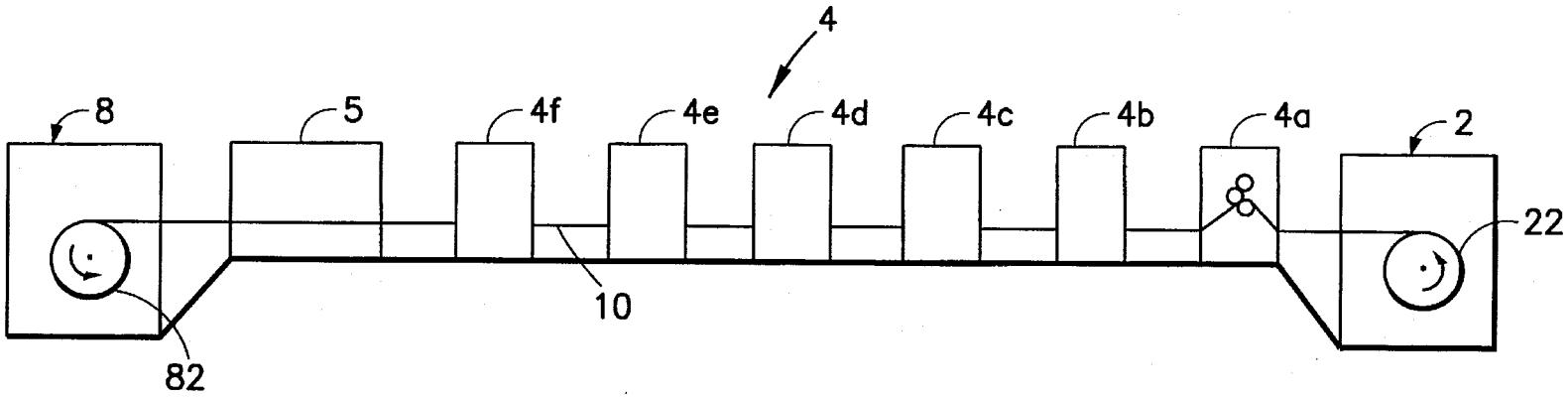
FIG. 1 is a diagrammatic side view of an apparatus in accordance with the invention for the printing of foil webs in web offset printing.

A diagrammatic side view of an apparatus in accordance with the invention for the printing of foil webs in web offset printing is shown in FIG. 1.

A foil web 10 wound on an unwinding roll 22 in an unwinding unit 2 is conducted into a printing unit 4 and then passes through an after-treatment unit 5 before it is wound up on a roll 82 in a winding unit 8.

The printing unit 4 comprises, for instance, four offset printing devices 4*a* to 4*d* for the four-color offset printing, and therefore one printing unit each for black, magneta, cyan, and yellow, and it furthermore comprises a gravure printing unit 4*e* as well as a varnishing unit 4*f*.

Figure 2:
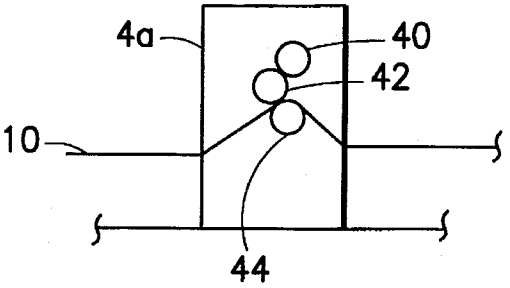
FIG. 2 diagrammatically shows a printing device having a printing unit provided therein.

Each offset printing device 4*a*–4*d* comprises, as diagrammatically shown in FIG. 2, a printing unit for indirect offset printing having a plate cylinder 40, a rubber-blanket cylinder 42, and an impression cylinder 44, the foil web being conducted between the rubber-blanket cylinder 42 and the impression cylinder 44. The printing devices are dry offset printing devices, both the inking units (not shown here) and the plate cylinders being temperature controlled in a manner not shown. The inking units are preferably cooled to a temperature of 25° to 26° C. and the plate cylinders preferably to a temperature of about 23° C.

Each of the printing devices 4*a*–4*d* has a replaceable printing unit, so that different printing units having different plate-cylinder diameters or plate sizes can be used.

Furthermore, a corona pretreatment unit, not shown in the figures, is arranged in front of the printing devices 4a–4d in order to make the foil web "friendly" for the offset application of the ink.

The printing devices 4a–4d have behind them a special ink unit 4e. The special ink unit 4e in the case of this embodiment is a gravure unit for printing the foil material with UV-drying gold inks. To this extent a UV-drying device is also provided in the special inking unit 4e in order to dry the ink directly before the further process steps.

It is frequently necessary, for marketing reasons, in the case of plastic foodstuff packings to have certain packing parts or sections appear in gold colors so as to stimulate the desire to buy. Since, however, the gold effect necessary for marketing reasons is not obtained with oxidatively drying gold inks, in this embodiment the special inking unit 4e for the printing of sections with UV-drying gold inks is provided.

A varnishing unit 4f is arranged behind the special inking unit 4e. Within the varnishing unit 4f, a layer of varnish, preferably acrylic varnish, is applied over the entire application of the ink which is applied by the printing devices 4a–4d as well as the special printing unit 4e. In this way, a uniform surface, which as a result is easier to work, is obtained for the following process steps. Furthermore, the acrylic varnish used here dries more easily than the oxidatively drying inks supplied in the printing devices 4a–4d.

After passage through the varnishing unit 4f, the foil web 10 is introduced into an after-treatment unit 5 in which the foil web is subjected to a heat-air drying and conducted over two cooling rolls, as described below. After emergence from the after-treatment unit 5, the foil web is wound up on a roll 82 in a winding unit 8.

Both the unwinding unit 2 and the winding unit 8 are provided with roll-change devices (not shown), so that a change of foil web roll can be effected without interrupting the printing. Furthermore, a device for controlling the winding tension of the web, explained in detail below, is present in the winding unit 8.

Figure 3:
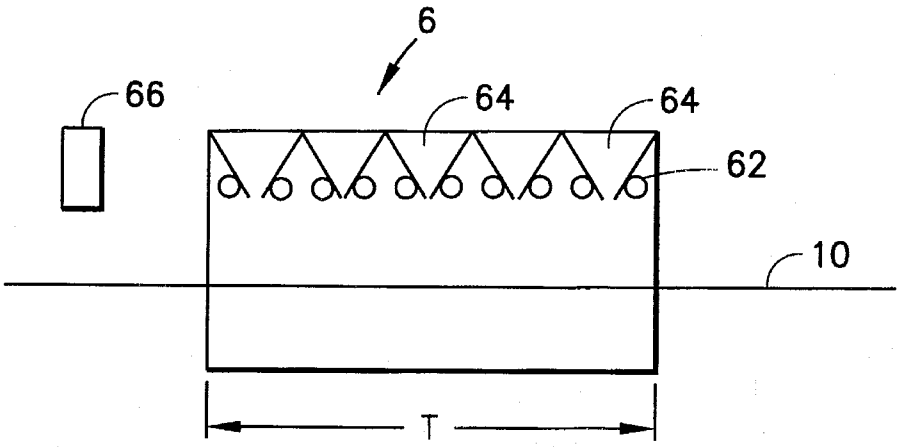
FIG. 3 diagrammatically shows a heat-air drying device provided in accordance with the invention.

The heat-air drying device 6 provided in the after-treatment unit 5 comprises on a drying path T, as shown in FIG. 3, heat-drying units 62 which in this embodiment consist of IR drying devices, as well as air-drying units 64, which are distributed in each case alternately over the drying path T. The corresponding proportion of heat-drying devices and air-drying devices 64 in the drying performance can be adjusted. In this way it is possible to adjust the nature of the drying to the printing conditions as a function of, for instance, the proportion of black in the printing, the nature of the ink and varnish used, etc. In each case, the drying comprises an air drying in order to feed sufficient oxygen for the oxidatively drying inks. Under certain printing conditions, however, the heating portion can be dispensed with entirely. The temperature of the drying air should lie within the range of 5° C. to 25° C. and therefore in the region of cold air.

The heat-air drying device can preferably be constructed of IR-air-drying devices, known per se, which are available on the market with a length of 17 cm per unit. In the apparatus of the invention, at least 15 of such units are used, with a total length accordingly of at least 2½ meters. The drying path T is preferably about 3.5 meters.

Figure 4:
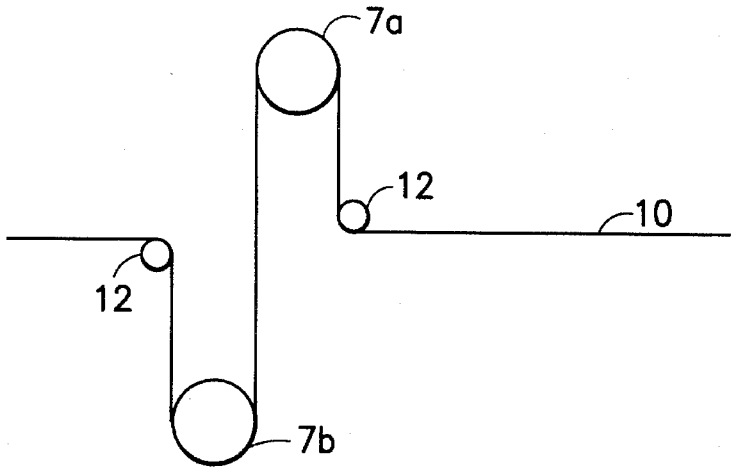
FIG. 4 shows two cooling rolls over which the foil web is guided in accordance with the invention before it is wound up.

After the foil web has passed through the heat-air drying device 6, it is first of all conducted with its unprinted side over a cooling roll 7a and then with its printed side over another cooling roll 7b, as can be noted from FIG. 4. In order to conduct the foil web over the largest possible angle around the cooling rolls 7a, 7b, the foil web 10 is deflected by guide rollers 12. The guide rollers 12 are not driven but have, however, especially developed surfaces so that the quality of the printing is not reduced by the deflection.

After the foil web has been moved over the two cooling rolls 7a, 7b, it passes through a device for controlling the winding tension of the web, before being wound onto the roll 82.

Figure 5:
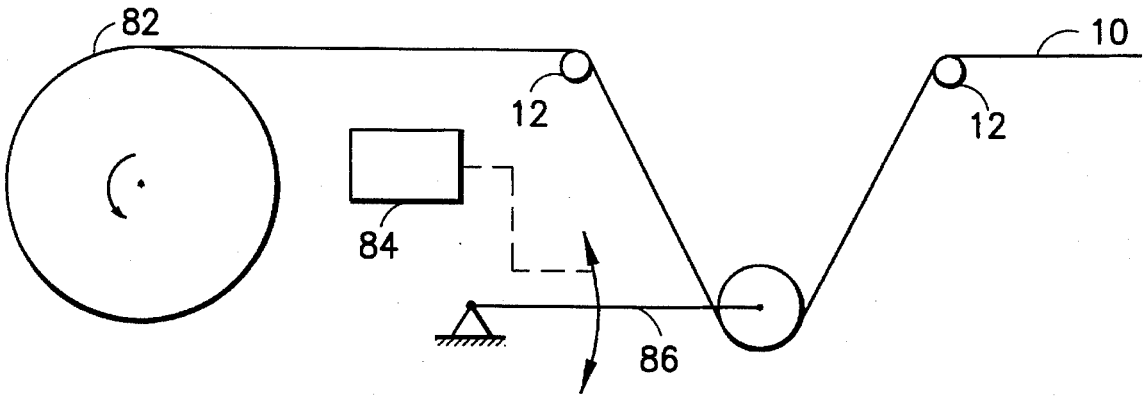
FIG. 5 diagrammatically shows a device for controlling the tension in the web before it is wound up.

In this embodiment, the device for controlling the tension of the web is formed by a deflection pendulum 86 the pendulum position of which can be controlled by a motor 84, possibly as a function of other parameters such as the thickness of the foil web, the speed of the web, etc. The guide rollers 12 described above are also used in the web tension control device, as can be noted from FIG. 5.

The winding tension of the web is so controlled in accordance with the invention that the tension of the web upon the winding decreases with increasing diameter of the roll. In the embodiment described, the relationship between diameter of the roll and tension of the web is linear. However, it is also possible to effect a progressive or degressive control depending, for instance, on the nature of the foil web 10.

With this embodiment of the apparatus of the invention described for the printing of foil webs with oxidatively drying inks in web offset printing, foil webs can be economically printed in medium-sized runs with good quality. In particular, the cutting of the extruded foil webs into sheets and the welding of the sheets together to form a foil web require prior to the further working which were required in the sheet offset process previously used are eliminated. By the combination of the features of the invention, the goal which has been desired for a long time by those skilled in the art of being able to print foil webs with oxidatively drying inks in web offset printing has been achieved in a surprising manner.

List of Reference Numerals

2 Unwinding web
4 Printing press
4a Printing unit, black
4b Printing unit, blue
4c Printing unit, magneta
4d Printing unit, yellow
4e Gravure unit, special inks
4f Varnishing unit, protective varnish
5 After-treatment unit
6 Heat-air drying device
7a Cooling roll
7b Cooling roll
8 Winding unit
10 Foil web
12 Guide rollers
22 Roll
40 Plate cylinder
42 Rubber-blanket cylinder
44 Impression cylinder
62 IR-drying unit
64 Cold-air drying unit
66 Powdering unit
82 Roll
84 Motor
86 Deflection pendulum

What is claimed is:

1. A method for the printing of foil webs in web offset printing, in which strongly oxidatively drying inks are used, the printed foil webs are subjected to a combined heat-air drying;

the printed foil webs, before being wound up, are conducted over at least one cooling roll, and the tension of the web upon the winding is reduced as the diameter of the roll increases.

2. A method according to claim 1, in which the foil web is subjected to a corona pretreatment before the printing.

3. A method according to claim 1, in which the inks are applied in water-less offset printing and the corresponding printing plates are temperature controlled.

4. A method according to claim 1, in which the inks are temperature controlled.

5. A method according to claim 1, in which a varnish, preferably an acrylic varnish, which covers the application of the ink is applied after the inking.

6. A method according to claim 1, in which the heat-air drying comprises a given proportion of heat drying and a given proportion of air drying as a function of the printing conditions.

7. A method according to claim 6, in which the drying air has a temperature within the range of 5° C. to 25° C.

8. A method according to claim 1 in which, before the winding up, the foil web is first of all conducted with its unprinted side over a first cooling roll and then conducted with its primed side over another cooling roll.

9. A method according to claim 1 in which the cooling roll or rolls are driven.

10. A method according to claim 1 in which the printed foil web is powdered before being wound up.

11. A method according to claim 1 in which the tension of the web upon the winding is decreased linearly with the increase in the diameter of the roll.

12. An apparatus for the printing of foil webs with strongly oxidatively drying inks in web offset printing, having an unwinding unit (2) in which the foil material (10) is unwound from a roll (22), at least one printing device (*4a–4d*) having in each case a printing unit and an inking unit;

an after-treatment unit which comprises a heat-air drying device (6) and at least one cooling roll (*7a, 7b*); and a winding device (8) in which the foil material is wound onto a roll (82) and which has a web-tension control device (84, which reduces the tension of the web with the increase in diameter of the roll upon winding.

13. An apparatus according to claim 12 in which each of the winding units (2, 8) has a roll-change device.

14. An apparatus according to claim 12 in which a corona pretreatment unit is arranged in front of the printing device (*4a–4d*).

15. An apparatus according to claim 12 in which the printing unit is a dry offset printing unit and the printing plate is temperature-controlled.

16. An apparatus according to claim 15, in which the inking unit is temperature-controlled.

17. An apparatus according to claim 12, in which the printing device (*4a–4d*) has replaceable printing units with different printing plate sizes for the printing of sections of different length.

18. An apparatus according to claim 12, in which, adjacent the offset printing device (*4a–4d*), there is arranged a gravure printing unit (*4e*) through which the foil material is conducted for the printing of special inks.

19. An apparatus according to claim 12, in which a varnishing unit (*4f*) is arranged behind the printing device (*4a–4d*).

20. An apparatus according to claim 12, in which the heat-air drying device (6) has heat drying units (62) and air drying units (64) which are in each case distributed over the drying path (T) and the proportion of each of which in the drying is adjustable as a function of the printing conditions.

21. An apparatus according to claim 20, in which the drying air has a temperature within the range of 5° C. to 25° C.

22. An apparatus according to claim 20, in which the heat-drying units (62) are IR-drying units.

23. An apparatus according to claim 12, in which the foil web (10), before being wound up, is first of all conducted with its unprinted side over a first cooling roll (*7a*) and only then with its printed side over another cooling roll (*7b*).

24. An apparatus according to claim 23, in which the cooling roll or rolls (*7a, 7b*) is (are) driven.

25. An apparatus according to claim 12, in which a powdering device (66) is arranged in front of the winding unit (8).

26. An apparatus according to claim 12, in which the winding tension of the web is decreased linearly as the diameter of the roll increases.

* * * * *